US006904250B2

(12) United States Patent
Nemoto

(10) Patent No.: US 6,904,250 B2
(45) Date of Patent: Jun. 7, 2005

(54) IMAGE FORMING APPARATUS

(75) Inventor: Akio Nemoto, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/809,479

(22) Filed: Mar. 26, 2004

(65) Prior Publication Data

US 2004/0228654 A1 Nov. 18, 2004

(30) Foreign Application Priority Data

Mar. 27, 2003 (JP) ..... 2003-087107

(51) Int. Cl.[7] ..... G03G 21/00

(52) U.S. Cl. ..... 399/124; 399/111; 399/388; 399/391

(58) Field of Search ..... 399/124, 111, 399/388, 391, 316; 271/264, 9.13

(56) References Cited

U.S. PATENT DOCUMENTS 4,272,180 A * 6/1981 Satomi et al.
4,412,734 A * 11/1983 Shibuya et al. ..... 399/124
6,009,288 A * 12/1999 Akutsu

* cited by examiner

*Primary Examiner*—Susan S. Y. Lee
*Assistant Examiner*—Peter Lee
(74) *Attorney, Agent, or Firm*—Fitzpatrick, Cella, Harper & Scinto

(57) ABSTRACT

An image forming apparatus has a first feeding unit for feeding a recording sheet, a detachable second feeding unit provided in the lower part of an image forming apparatus main body, an image forming portion for forming an image on the recording sheet, a first feeding path for feeding the recording sheet from the first feeding unit to the image forming portion, a second feeding path for feeding the recording sheet from the second feeding unit to the image forming portion, and a guide member for guiding the recording sheet fed at a merge portion of the second feeding path merged with the first feeding path, wherein the guide member is pivoted on the upstream side in the recording sheet feed direction, rotatably by the recording sheet fed from the second feeding path.

8 Claims, 11 Drawing Sheets

IMAGE FORMING APPARATUS

BACKGROUND OF THE INVENTION

1. Field of the Invention

The present invention relates to an image forming apparatus comprising two feeding means and feeding paths.

2. Description of the Related Art

A conventional image forming apparatus will be explained with reference to the drawings. FIG. 10 is a cross sectional view of the conventional image forming apparatus, and FIG. 11 is an enlarged view of a merge portion A of a first feeding path and a second feeding path in FIG. 10. According to the conventional image forming apparatus, among recording sheets piled on a first feeding port 3 on the image forming apparatus main body 1 side, only the uppermost part recording sheet is separated by a first feeding unit 4 so as to pass through a first feeding path 7 and the lower surface of a feed guide 9, and thereby being fed to an image forming portion 5. The recording sheet fed to the image forming portion 5 has an image transferred onto the paper surface of the recording sheet by the image forming portion 5, and the image fixed by a fixing unit 6 so as to be discharged to the outside of the image forming apparatus main body 1. Moreover, the recording sheet fed from an option unit 2 passes through a second feeding path 8 so as to be merged with the first feeding path 7 of the main body immediately before the image forming portion 5 of the image forming apparatus. The recording sheet has an image transferred onto the paper surface thereof by the image forming portion 6, and the image is fixed by the fixing unit 6 so as to be discharged to the outside of the image forming apparatus main body 1 in the same manner.

As shown in FIG. 11, at the merge portion A of the first feeding path 7 and the second feeding path 8, the sheet passing through the first feeding path 7 is fed to the image forming portion 5 on the lower surface of the feed guide 9 without contacting with the lower surface of the feed guide 9, and the recording sheet passing through the second feeding path 8 is fed with the recording sheet top end feed direction switched to the image forming portion 5 direction by the feed guide 9.

However, according to the above-mentioned conventional image forming apparatus, since a fixed type feed guide member is disposed at the merge portion of the second feeding path and the first feeding path, and thus in the case where the recording sheet fed from the first feeding port or the second feeding port is jammed, a problem is involved in that the jammed recording sheet is cut off by the feed guide at the time of the jamming process.

Moreover, a problem is involved in that a paper hopping sound is generated due to the crash of the rear end of the recording sheet with the feed guide at the moment of passing by the top part of the merge portion at the time when the rear end of the recording sheet fed from the second feeding path passes through the merge portion of the first feeding path and the second feeding path.

SUMMARY OF THE INVENTION

Accordingly, an object of the present invention is to provide an image forming apparatus capable of easily processing a jammed recording sheet without causing damage thereto, and alleviating a paper hopping sound when the rear end of the recording sheet passes through the merge portion.

In order to solve the above-mentioned problems, a representative configuration of an image forming apparatus according to the present invention is an image forming apparatus comprising first feeding means for feeding a recording sheet, detachable second feeding means provided in the lower part of an image forming apparatus main body, image forming means for forming an image on the recording sheet, a first feeding path for feeding the recording sheet from the first feeding means to the image forming means, a second feeding path for feeding the recording sheet form the second feeding means to the image forming means, and a guide member for guiding the recording sheet fed from the first feeding path and the second feeding path and the second feeding path, to the image forming means, wherein when the guide member is rotated by pushing with the recording sheet fed from the second feeding path, the rotation of the guide member is limited by the image forming means.

The above-mentioned image forming means is provided detachably, and the guide member can be rotated largely at the time of detaching the above-mentioned image forming means. Thereby, even in the case where the recording sheet is jammed, a jamming process can be executed easily without damaging the jammed recording sheet by detaching the image forming apparatus and rotating and largely opening the guide member.

Moreover, since a gap or a slit to be the cause of generating jamming between the fit feeding means and the image forming means can be eliminated from the first feeding path to be fed by using the upper surface of the guide member as the first feeding path, the jamming generation frequency can dramatically be reduced.

Further, since the guide member is made of a thin elastic sheet material, it is rotated by the recording sheet fed from the second feeding path, curved by the contact with the image forming means, and forms a smooth feeding path. Thereby, the paper hopping noise at the time when the rear end of the recording sheet passes through the merge portion of the feeding path can be alleviated. Furthermore, since the guide member is made of a light material such as a sheet material, the possibility of the jamming derived from butting with the guide member in the feed from the second feeding path can dramatically be reduced.

In the above-mentioned image forming apparatus, the guide member may have a structure with the second feeding path closed when the recording sheet is fed in the first feeding path and using the upper surface of the guide member as the first feeding path.

Since a gap or a slit to be the cause of generating the jamming between the first feeding means and the image forming means can be eliminated from the first feeding path to be fed by using the upper surface of the guide member as the first feeding path, the generation frequency of the jamming can dramatically be reduced.

In the above-mentioned image forming apparatus, the guide member may have a structure made of a thin elastic sheet material so as to be rotated by the recording sheet fed from the second feeding path, curved by the contact with the image forming means, and form a smooth feeding path.

According to the configuration, the guide member is made of a thin elastic sheet material so as to be rotated by the recording sheet fed from the second feeding path, curved by the contact with the image forming means, and form a smooth feeding path. Thereby, a paper hopping noise at the time when the rear end of the recording sheet passes through the merge portion of the feeding path can be alleviated. Furthermore, since the guide member is made of a light material such as a sheet material, the possibility of the jamming derived from butting with the guide member in the feed from the second feeding path can dramatically be reduced.

Furthermore, in the above-mentioned image forming apparatus, the image forming means may have a structure provided detachably such that the guide member is rotated largely at the time of detaching the image forming means.

DETAILED DESCRIPTION OF THE INVENTION

[First Embodiment]

Figure 1:
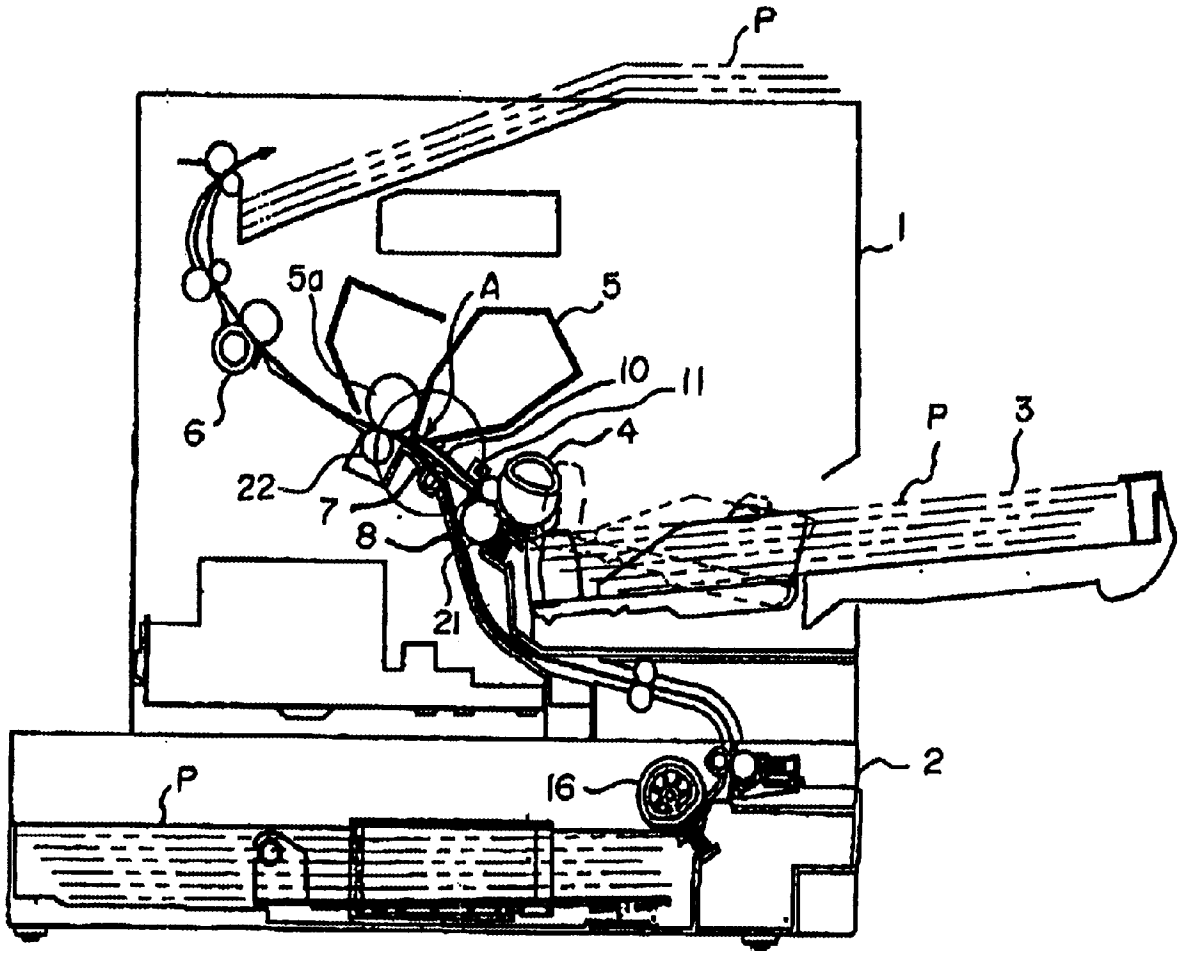
FIG. 1 is a cross sectional view of an image forming apparatus according to a first embodiment of the present invention.

A first embodiment of an image forming apparatus according to the present invention will be explained with reference to the drawings. FIG. 1 is a cross sectional view of an image forming apparatus according to this embodiment. As shown in FIG. 1, the image forming apparatus comprises an image forming apparatus main body 1 and an option unit 2 detachable to the lower part of the image forming apparatus main body 1.

In this embodiment, a first feeding path 7 for feeding a recording sheet P from first feeding means to an image forming portion 5, and a second feeding path 8 for feeding the recording sheet P from second feeding means (not shown) to the image forming portion 5 are provided. At a merge portion A with a 90 degrees or less angle formed by the feeding paths 7, 8, the second feeding path 8 is merged with the first feeding path 7. Then, at the merge portion A, a feed guide 10 constituting a part of the first feeding path 7 is disposed above the second feeding path 8 so as to cover the same.

Figure 2:
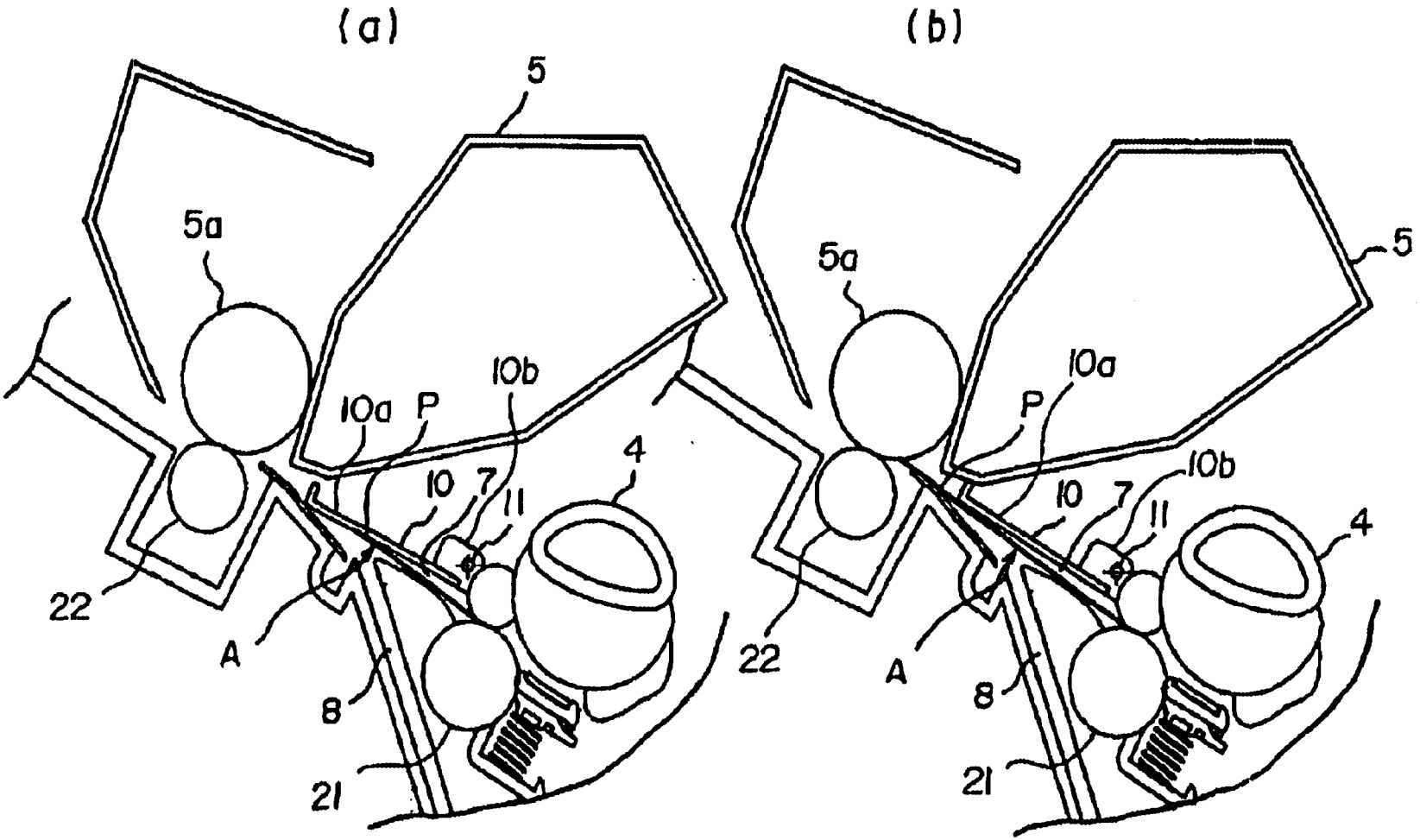
FIG. 2 is a diagram for explaining the feed of a recording sheet in a first feeding path.
Figure 5:
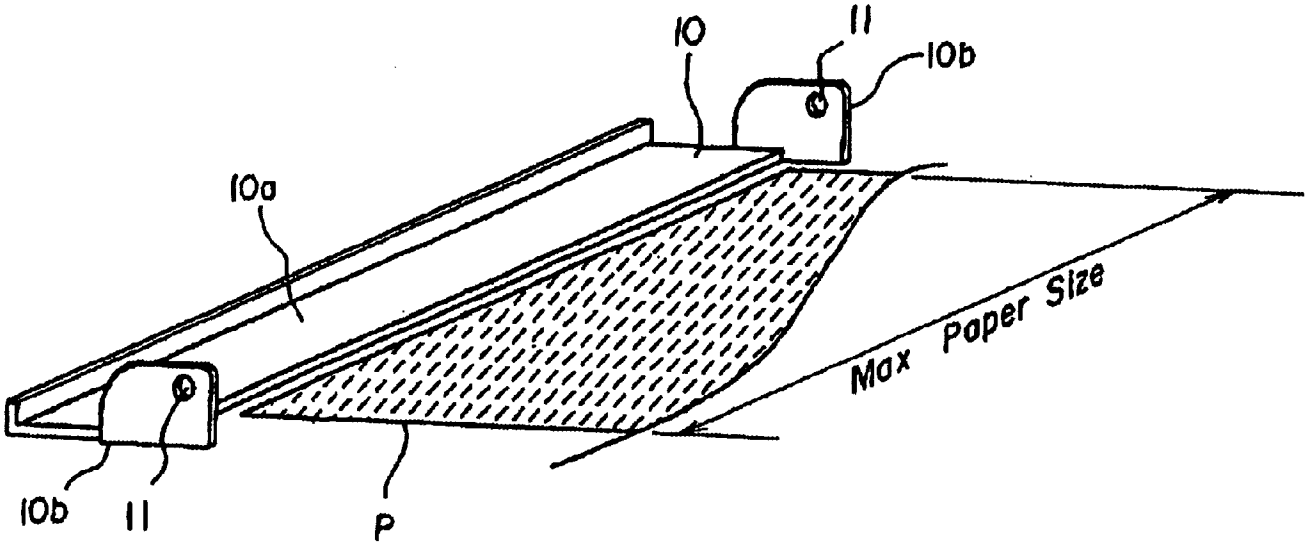
FIG. 5 is a perspective view of a feed guide.

As shown in FIGS. 2 and 5, the feed guide 10 comprises a plate like main body 10*a* and an upright piece 10*b* formed in the rear part both ends thereof. Small holes formed in the upright pieces 10*b* serve as the rotation center 11 of the feed guide 10. Then, as shown in FIG. 2, the first feeding path 7 is formed by the upper guide and the lower guide, and the feed guide 10 constitutes a part of the upper guide of the first feeding path 7 in the merge portion A, the feed guide 10 is disposed such that the rotation center 11 formed in the upright piece 10*b* is disposed on the upstream side in the recording sheet P feed direction with the rotation center 11 pivoted by a pin (not shown) on the apparatus main body side. In the case where the recording sheet P is not moved either to the first feeding path 7 or the second feeding path 8, the feed guide 10 has the top end of the plate like main body 10*a* dropped on the lower guide of the first feeding path 7 by its self weight so as to close the first feeding path 7 and the second feeding path 8 (see FIG. 2A).

The feed guide 10 has a structure to be rotated around the rotation center 11 by 120 degrees in the front and rear sides. Therefore, as shown in FIG. 2, although the ration by a large angle cannot be tolerated in a state with the image forming portion (process cartridge) 5 mounted, in the case where the image forming portion 5 is detached from the apparatus main body, the large angle rotation of the guide member 10 can be tolerated so as to open the first feeding path 7 of the merge portion A.

As to the recording sheets P piled on a first feeding port 3 on the image forming apparatus main body 1 side, only the uppermost part recording sheet P is separated by a first feeding unit 4 (separating roller) as the first feeding means so as to be sent out by a feed roller pair 21. The recording sheet P further passes through the first feeding path 7 and passes through the lower surface of the feed guide 10 so as to be fed to the image forming portion 5 as the image forming means while pushing up the feed guide 10 as the guide member closing the first feeding path 7. The recording sheet P fed to the image forming portion 5 is nipped by a photosensitive drum 5*a* of the image forming portion 5 and a transfer roller 22 so that an image is transferred onto the paper surface of the recording sheet P by the photosensitive drum 5*a* and the image is fixed by a fixing unit 6 so as to be discharged to the outside of the image forming apparatus main body 1.

Moreover, the recording sheet P fed from the second feeding unit 16 as the second feeding means of the option unit 2 is sent to the image forming portion 5 through the second feeding path 8. The top end P1 of the recording sheet P is contacted with the lower surface of the feed guide 10 so as to have the feed direction oriented toward the image forming portion 5 direction at the merge portion A immediately before the image forming portion 5 of the image forming apparatus and merged with the first feeding path 7 of the main body. In the same manner, an image is transferred onto the paper surface of the recording sheet P by the image forming portion 5 and the image is fixed by the fixing unit 6 so as to be discharged to the outside of the image forming apparatus main body 1.

FIG. 2A shows a state of the recording sheet fed from the first feeding port 3 to be contacted with the feed guide 10, and FIG. 2B shows the state with the feed guide 10 rotated by the recording sheet fed from the first feeding port 3. Moreover, FIG. 3A shows the state of recording sheet fed from the second feeding path to be contacted with the feed guide 10, and FIG. 3B shows the state with the feed guide 10 rotated by the recording sheet fed from the second feeding path. FIGS. 2B and 3B show the state with the rotation of the feed guide 10 limited by the image forming portion 5.

Figure 3:
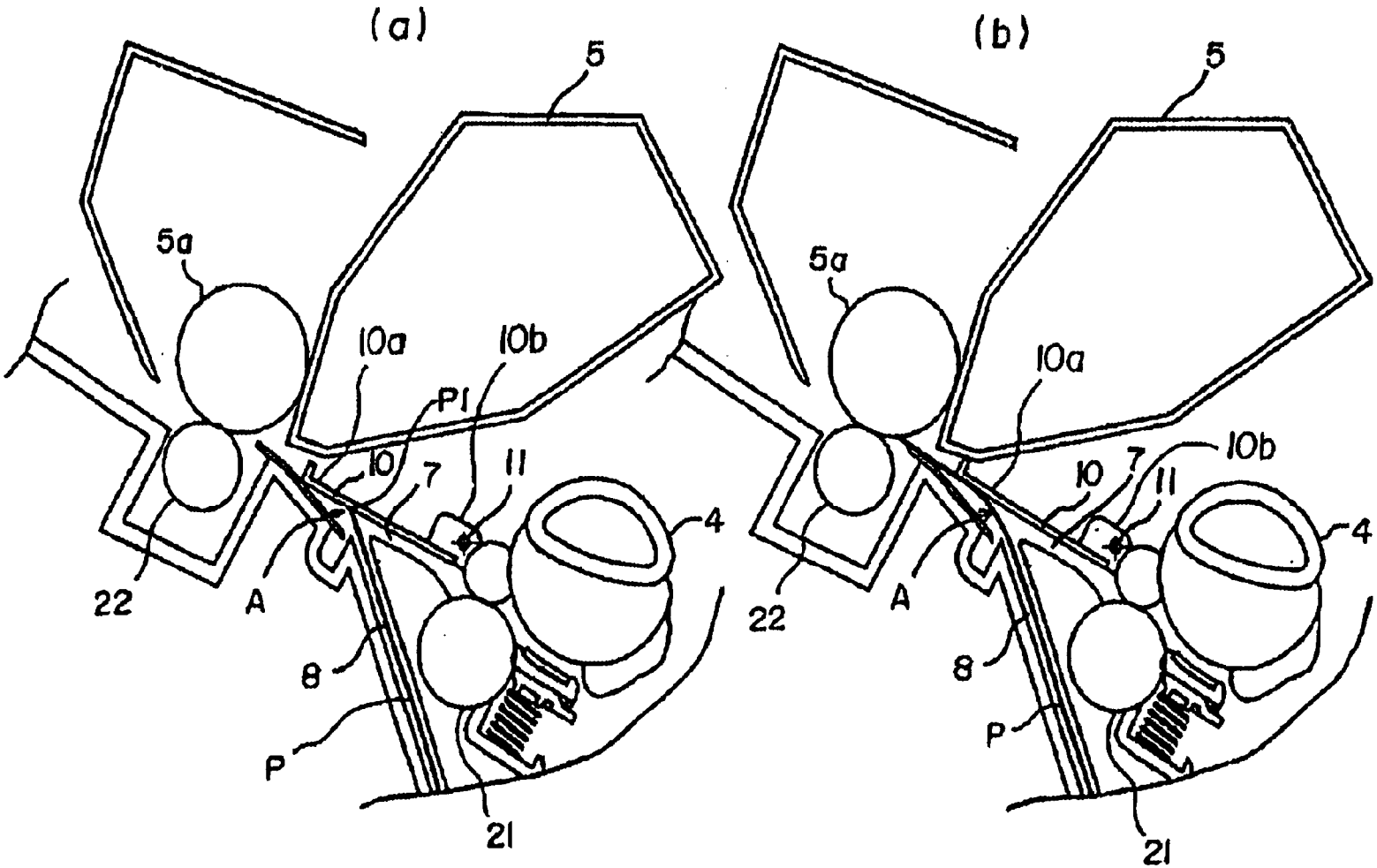
FIG. 3 is a diagram for explaining the feed of a recording sheet in a second feeding path.

As shown in FIGS. 2 and 3, the feed guide 10 is disposed so as to be rotated around the rotation center 11 provided above the both end parts (see FIG. 5) of the image forming apparatus main body 1 and the first feeding path 7. Therefore, as shown in FIGS. 2A and 3B, on the recording sheet P fed from the first feeding path 7 or the second feeding path 8, first the top end P1 is butted with the feed guide 10. At the time, the feed guide 10 pivoted by the rotation center 11 is moved upward by the crash of the top end P1 of the recording sheet P for alleviating the impact so that the recording sheet P forms a loop in the state with the feed guide 10 moved, and furthermore, the top end P1 of the recording sheet P is guided to the image forming portion 5 direction according to the guide by the feed guide 10. Thereafter, as shown in FIGS. 2B and 3B, the feed guide 10 is rotated by the feed force of the recording sheet until the feed guide 10 is contacted with the image forming portion 5, and then the recording sheet is fed to the image forming portion 5.

Figure 4:
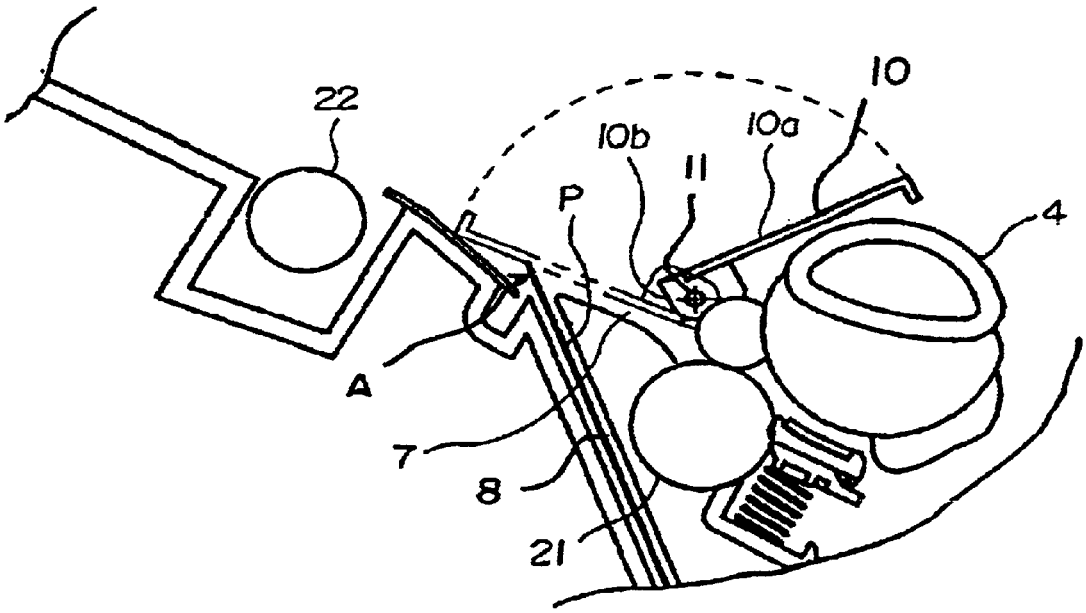
FIG. 4 is an image diagram at the time of a jamming process.

Moreover, as shown in FIG. 4, in the case where jamming is generated, by detaching the cartridge image forming portion 5 from the image forming apparatus main body 1, a space can be produced above the feed guide 10 for opening the first feeding path 7 by rotating the feed guide 10 around the rotation center 11. Then, since the merge portion A is exposed according to the movement of the feed guide 10, the jammed recording sheet P can easily be eliminated.

Since the feed guide 10 is provided rotatable, even when the recording sheet is jammed, by detaching the cartridge image forming portion 5 and rotating the feed guide 10 for largely opening the same, the jamming process can easily be executed without damaging the jammed recording sheet. Moreover, since the top end of the recording sheet butted against the feed guide 10 rotates the feed guide 10, the recording sheet forms a loop so that the feed guide 10 functions as a simple resist shutter so that the printing accuracy (obliqueness, or the like) can be improved.

[Second Embodiment]

Next, a second embodiment of an image forming apparatus according to the present invention will be explained with reference to the drawings. The same numerals are provided for the same parts in the above-mentioned first embodiment, and the explanation is omitted here.

Figure 6:
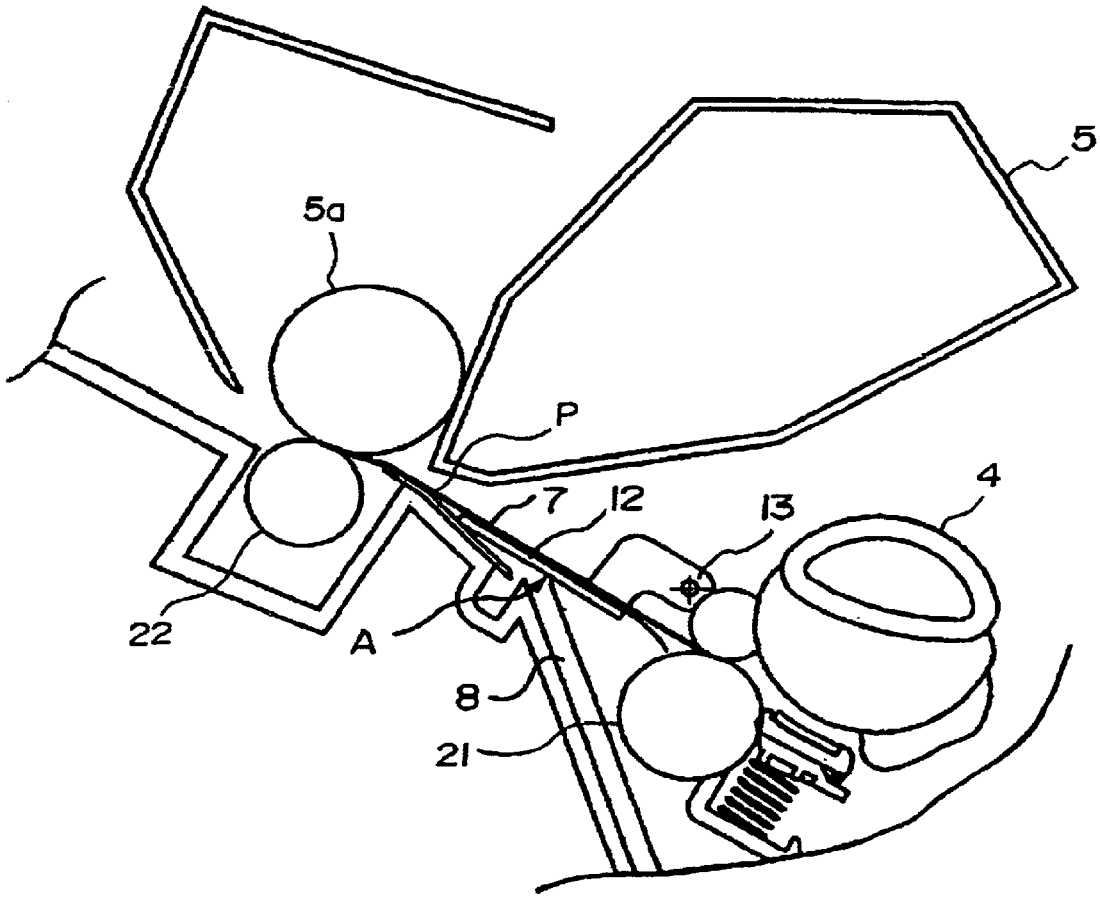
FIG. 6 is a diagram for explaining the feed of a recording sheet in a first feeding path in a second embodiment of the present invention.
Figure 7:
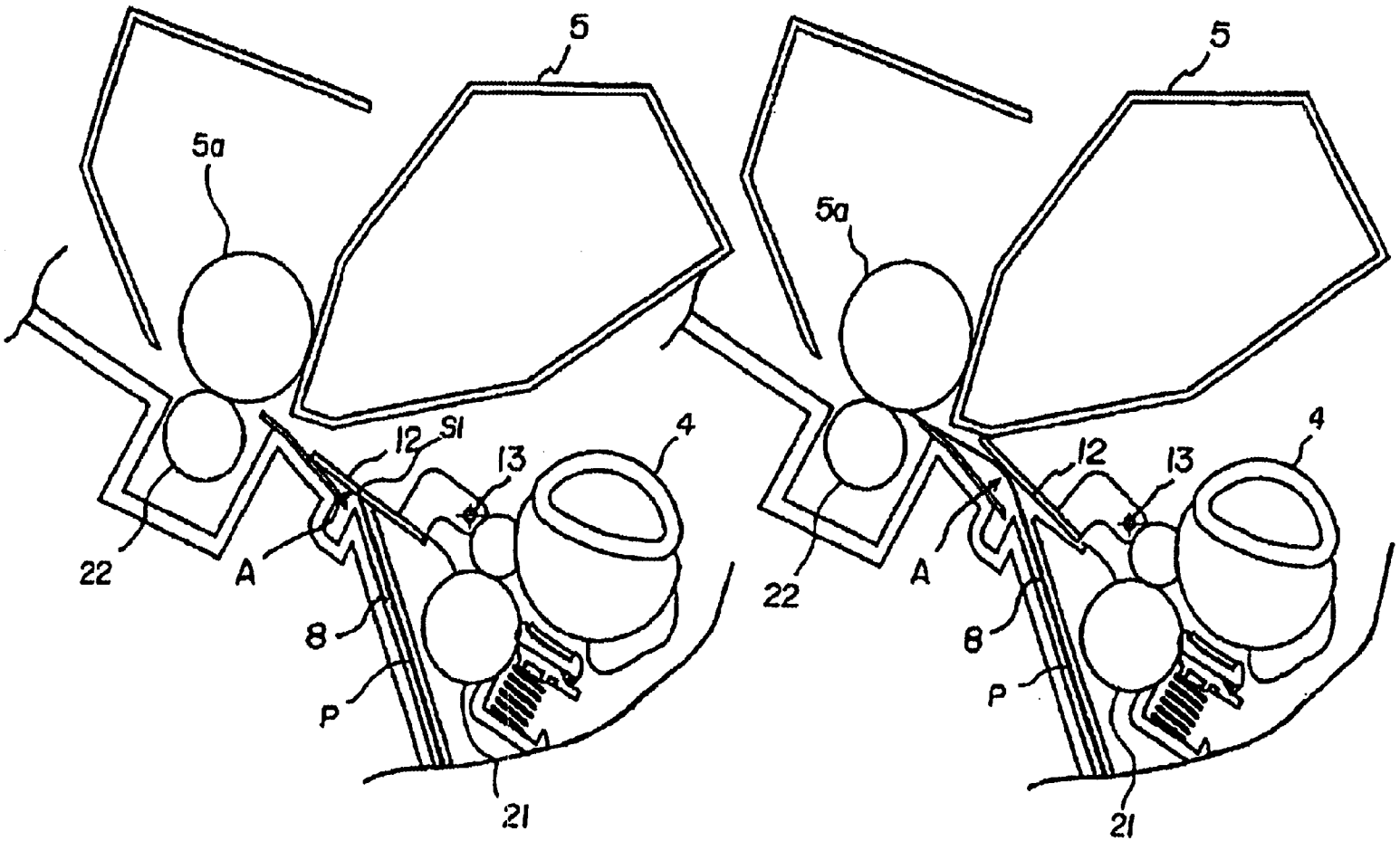
FIG. 7 is a diagram for explaining the feed of a recording sheet in a second feeding path.

FIG. 6 is a diagram for explaining the feed of a recording sheet in the first feeding path, and FIGS. 7A and 7B are diagrams for explaining the feed of the recording sheet in the second feeding path. As shown in FIG. 6, the image forming apparatus of this embodiment is provided with a feed guide 12 for forming the lower guide of the first feeding path 7 instead of the feed guide 10 for forming the upper guide of the first feeding path 7 in the first embodiment. In this embodiment, the first feeding path 7 is the pass for passing through the upper surface of the feed guide 12 as the guide member, and the feed guide 12 is disposed so as to close the merge portion A of the second feeding path 8 and the first feeding path 7. Furthermore, the feed guide 12 is provided so as to rotate around the rotation center 13, and as in the first embodiment of FIG. 5, the rotation center 13 is disposed on the both outer sides of the maximum paper size.

As shown in FIGS. 7A and 7B, the recording sheet fed from the second feeding path 8 of the lower surface of the feed guide 12 is butted against the feed guide 12 so as to push the feed guide 12 upward for forming a loop. Then, by rotating the feed guide 12 with the rotation center 13 provided as the rotation axis by the feed force of the recording sheet until it is butted against the image forming portion 5, it is withdrawn from the merge portion A so as to ensure the feeding path.

Figure 8:
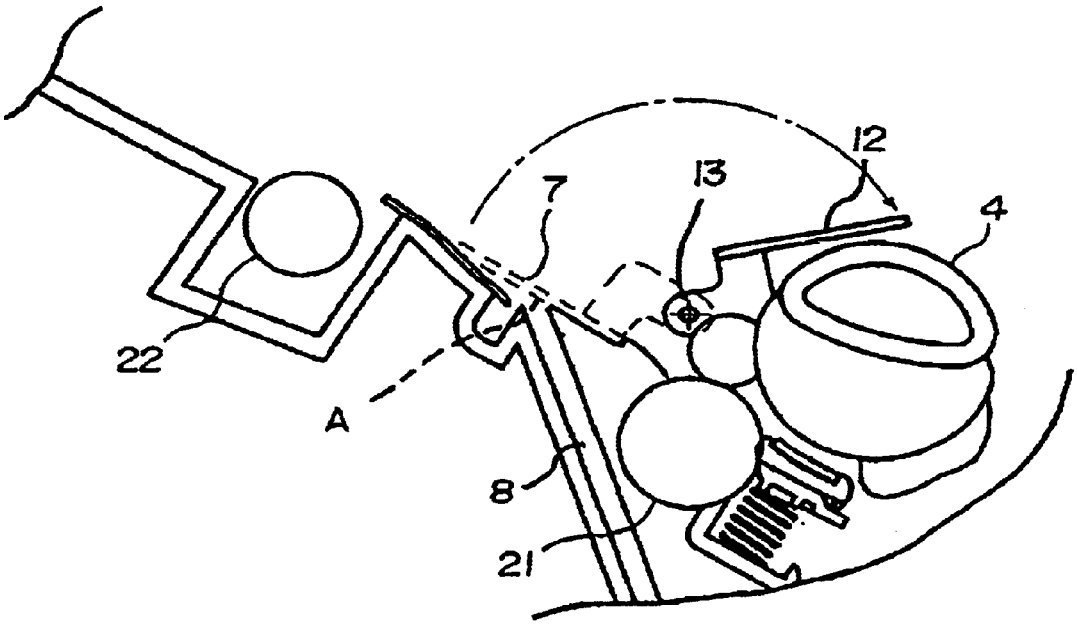
FIG. 8 is an image diagram at the time of a jamming process.

Moreover, as shown in FIG. 8, by detaching the cartridge image forming portion 5, the feed guide 12 can largely be rotated.

As mentioned above, since the recording sheet passes through above the feed guide 12, a gap or a slit to be the cause of generating jamming be the first feeding port 3 and the image forming portion 5 can be eliminated from the first feeding path 7, and thus the jamming generation frequency can dramatically be reduced.

Further, even if jamming is generated by any chance, since the merge portion A can be opened only by detaching the cartridge image forming portion 5 and rotating the feed guide 10, the jamming process can easily be executed.

Furthermore, since the feed guide 12 is disposed so as to close the opening of the second feeding path 8 so that the recording sheet passes through above the feed guide 12, the recording sheet passing through the first feeding path 7 cannot be butted against the gap part of the merge point A with the second feeding path 8, and therefore, generation of jamming can be prevented at the merge portion A in the first feeding path 7.

Moreover, even if the recording sheet sent from the second feeding path 8 is jammed, by detaching the cartridge image forming portion 5 and opening the feed guide 12 by largely rotating the same, the jamming process can easily be executed without damaging the jammed recording sheet in the second feeding path 8. In addition, since the recording sheet forms a loop at the time when the top end of the recording sheet is butted against the feed guide 12 so as to rotate the feed guide 12, the feed guide 12 functions as a simple resist shutter so that the printing accuracy (obliqueness, or the like) can be improved.

[Third Embodiment]

Next, a third embodiment of an image forming apparatus according to the present invention will be explained with reference to the drawings. The same numerals are provided for the same parts in the first embodiment, and the explanation is omitted here.

Figure 9:
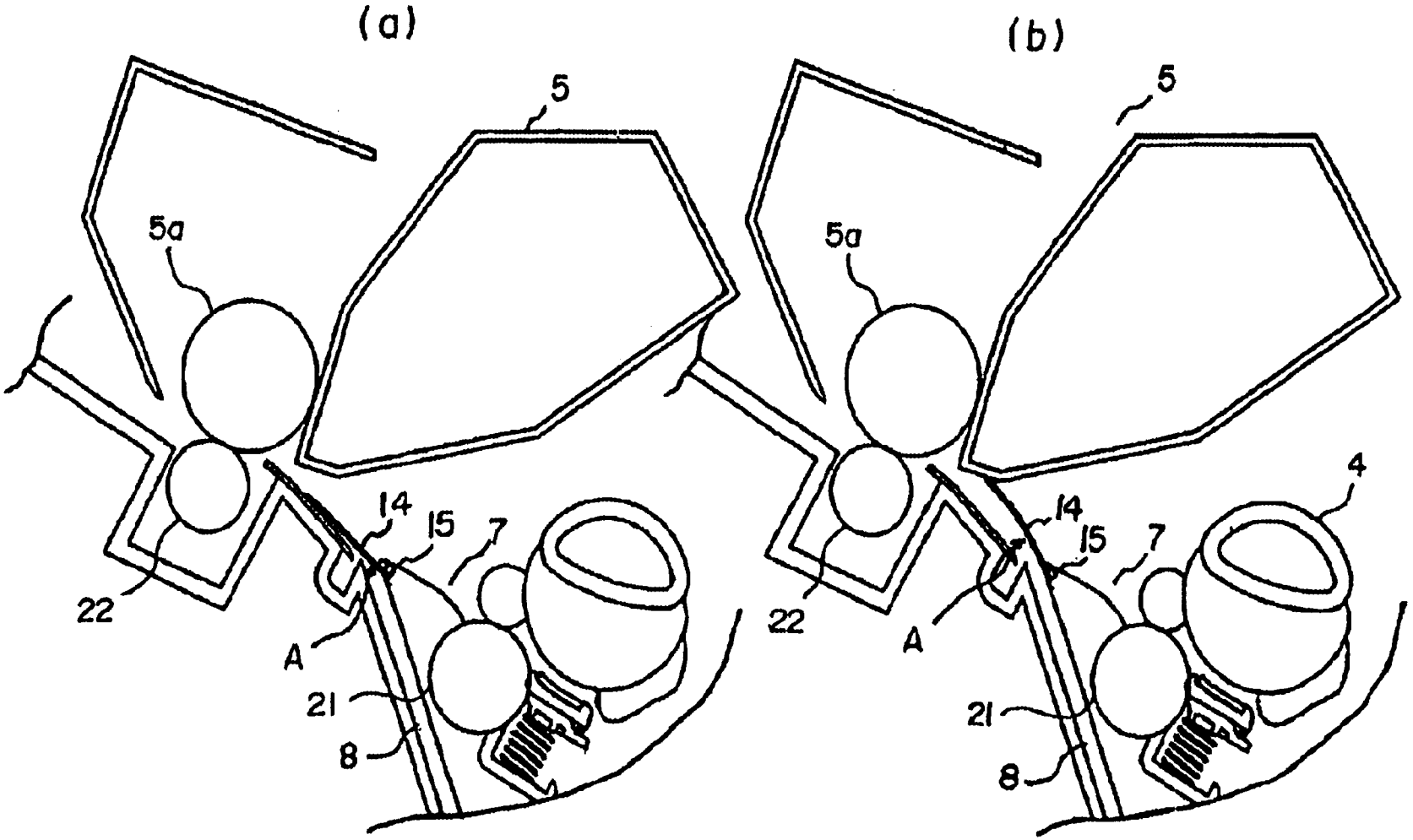
FIG. 9 is a diagram for explaining the feed of a recording sheet in a first feeding path and a second feeding path according to a third embodiment of the present invention.
Figure 10:
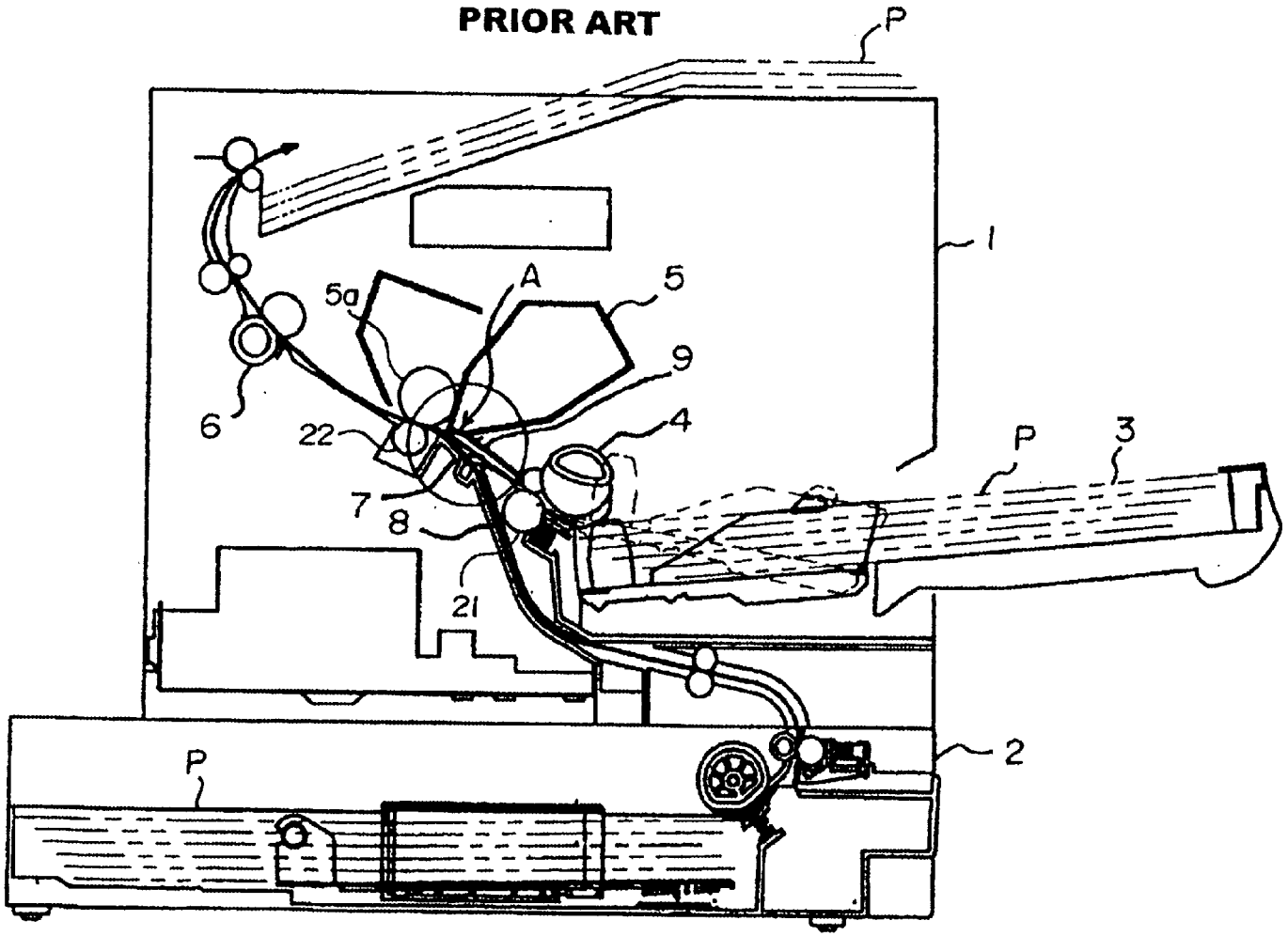
FIG.10 PRIOR ART
FIG. 10 is a cross sectional view of an image forming apparatus of a conventional embodiment.
Figure 11:
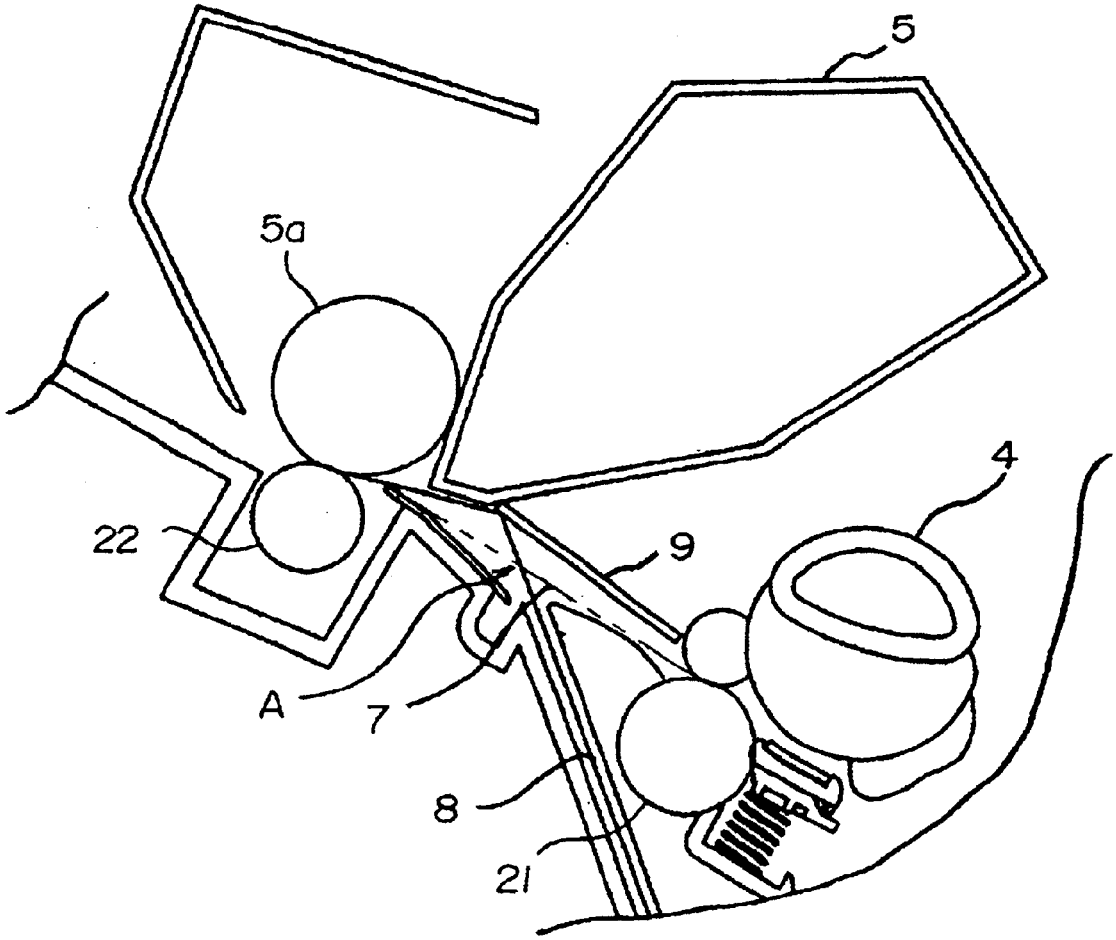
FIG.11 PRIOR ART
FIG. 11 is an enlarged view of a merge portion of feeding paths of the conventional embodiment.

FIG. 9A is a diagram for explaining the feed of a recording sheet in the first feeding path according to this embodiment, and FIG. 9 is a diagram for explaining the feed of the recording sheet in the second feeding path. As shown in FIG. 9, the image forming apparatus of this embodiment is provided with a flexible feed guide 14 instead of the feed guide 10 of the first embodiment without deformation. In this embodiment, a thin elastically deformable sheet member such as an OHT sheet is used as the feed guide 14 as the guide member, and the rotation center 15 of the feed guide 14 is disposed at a position closest possible to the merge portion A of the first feeding path 7 and the second feeding path 8.

The recording sheet having passed through the first feeding path 7 passes through the upper surface of the feed guide 14 as in the second embodiment. Further, the recording sheet having passed through the second feeding path 8 is fed while lifting up the feed guide 14. At the time, since the feed guide 14 comprises a flexibly deformable sheet member as mentioned above so that the feed guide 14 is deformed so as to be curved by having the top end being butted against the image forming portion 5 as shown in FIG. 9B, an extremely smooth arc like feeding path is formed. Therefore, the recording sheet P passing through the second feeding path 8 is curved along the curved feed guide 14 so as to form a loop.

Moreover, although it is not shown in the figure, at the time when the image forming portion 5 is eliminated, the feed guide 14 can be opened largely to the feeding port side as in the first and second embodiments.

As mentioned above, since the recording sheet passes through above the feed guide 14, a gap or a slit to be the cause of generating jamming between the first feeding port 3 and the image forming portion 5 can be eliminated from the first feeding path 7, and thus the jamming generation frequency can dramatically be reduced. In addition, even if the jamming is generated, the jamming process can easily be executed only by detaching the cartridge image forming portion 5.

Further, even when the recording sheet fed from the second feeding path 8 is jammed, by detaching the cartridge image forming portion 5 and rotating the feed guide 14 for largely opening the same, the jamming process can easily be executed without damaging the jammed recording sheet.

Furthermore, since the thin elastically deformable sheet member such as an OHT sheet is used as the feed guide 14, the feeding path forms a continuous smooth arc so that the paper hopping noise at the time when the rear end of the recording sheet passes through the merge portion A of the first feeding path 7 and the second feeding path 8 can be alleviated. Since the feed guide 14 is made of a light material such as a sheet material, the possibility of the jamming derived from being butted against the feed guide 14 in the feed from the second feeding path 8 can dramatically be reduced.

What is claimed is:

1. An image forming apparatus comprising:

image forming means for forming an image on a recording sheet;

a first feeding path for feeding the recording sheet to the image forming means;

a second feeding path for feeding the recording sheet to the image forming means; and a guide member rotatably provided at a merge portion of the first feeding path and the second feeding path for guiding the fed recording sheet to the image forming means, wherein when the guide member is rotated by pushing with the recording sheet fed through the second feeding path, the rotation of the guide member is limited by the image forming means.

2. The image forming apparatus according to claim 1, wherein the guide member doses the first feeding path and the second feeding path, and the recording sheet fed from the first feeding path and the second feeding path rotate the guide member and is fed to the image forming means.

3. The image forming apparatus according to claim 1, wherein the guide member closes the second feeding path at the merge portion when the recording sheet is fed from the first feeding path to the image forming means, and the upper surface of the guide member is used as the first feeding path.

4. The image forming apparatus according to claim 1, wherein the guide member is made of a thin elastic sheet material so as to be rotated by the recording sheet fed from the second feeding path, and curved by the contact with the image forming means for forming a smooth feeding path.

5. The image forming apparatus according to any of claims 1 to 3, wherein the image forming means is provided detachably from an apparatus main body and the guide member is rotated at the time of detaching the image forming means so as to expose the merge portion.

6. An image forming apparatus comprising:

a process cartridge provided detachably to an apparatus main body;

a first feeding unit;

a first feeding path connected the first feeding unit with the process cartridge;

a second feeding unit;

a second feeding path connected the second feeding unit with the process cartridge; and a rotatable guide member disposed at a merge portion of the first feeding path and the second feeding path so as to close the second feeding path, wherein the guide member is rotated by pushing with a recording sheet to be fed in the second feeding path so as to be contacted with the process cartridge.

7. The image forming apparatus according to claim 6, wherein the guide member is provided so as to close also the first feeding path, and it is rotated by pushing with the recording sheet to be fed in the first feeding path so as to be contacted with the process cartridge.

8. The image forming apparatus according to claim 6 wherein the guide member is made of a thin elastic sheet material so as to be rotated by pushing with the recording sheet fed from the second feeding path, and curved by the contact with an image forming means for forming a smooth feeding path.

* * * * *

UNITED STATES PATENT AND TRADEMARK OFFICE

CERTIFICATE OF CORRECTION

PATENT NO. : 6,904,250 B2
DATED : June 7, 2005
INVENTOR(S) : Akio Nemoto

It is certified that error appears in the above-identified patent and that said Letters Patent is hereby corrected as shown below:

Column 1,
Line 38, “with” should be deleted.

Column 2,
Line 7, “form” should read -- from --.

Column 4,
Line 9, “ration” should read -- rotation --.

Column 5,
Line 64, “be” should read -- between --.

Column 7,
Line 35, “doses” should read -- closes --.
Line 37, “rotate” should read -- rotates --.

Column 8,
Lines 17 and 20, “connected” should read -- connecting --.
Line 34, “claim 6” should read -- claim 6, --.

Signed and Sealed this

Twenty-seventh Day of September, 2005

JON W. DUDAS
*Director of the United States Patent and Trademark Office*